US006035651A

United States Patent [19]

Carey

[11] Patent Number: 6,035,651

[45] Date of Patent: Mar. 14, 2000

[54] START-UP METHOD AND APPARATUS IN REFRIGERATION CHILLERS

[75] Inventor: Michael D. Carey, Holmen, Wis.

[73] Assignee: American Standard Inc., Piscataway, N.J.

[21] Appl. No.: 08/872,870

[22] Filed: Jun. 11, 1997

[51] Int. Cl.[7] ..... F25B 41/04; F25B 49/00

[52] U.S. Cl. ..... 62/115; 62/204; 62/219

[58] Field of Search ..... 62/224, 219, 204, 62/115

[56] References Cited

U.S. PATENT DOCUMENTS

| | | | |
|---|---|---|---|
| 2,186,782 | 1/1940 | Erbach | 62/219 X |
| 4,286,438 | 9/1981 | Clarke | 62/216 |
| 4,475,686 | 10/1984 | Huelle et al. | 236/68 C |
| 4,476,691 | 10/1984 | Ozu | 62/217 |
| 4,549,404 | 10/1985 | Lord | 62/224 |
| 4,593,535 | 6/1986 | Ikeda et al. | 62/217 |
| 5,088,303 | 2/1992 | Da Costa | 62/498 |
| 5,224,354 | 7/1993 | Ito et al. | 62/210 |
| 5,303,562 | 4/1994 | Bahel et al. | 62/222 |
| 5,355,691 | 10/1994 | Sullivan et al. | 62/204 X |
| 5,435,145 | 7/1995 | Jaster | 62/115 |

*Primary Examiner*—William Wayner
*Attorney, Agent, or Firm*—William J. Beres; William O'Driscoll; Peter D. Ferguson

[57] ABSTRACT

The existence of inverted start conditions in a refrigeration chiller is accurately identified by sensing the liquid level in the chiller evaporator. That liquid level is indicative of the location of the chiller's refrigerant charge at start-up. If the sensed liquid level is below a predetermined level, an inverted start condition is verified to exist. Failed starts and chiller system shutdowns are reduced or avoided as compared to systems in which less reliable indicators are used to identify the existence of inverted start conditions.

22 Claims, 1 Drawing Sheet

START-UP METHOD AND APPARATUS IN REFRIGERATION CHILLERS

BACKGROUND OF THE INVENTION

The present invention relates to liquid chillers of the type which provide chilled water for industrial process and/or comfort conditioning applications. More particularly, the present invention relates to a screw compressor-based water chiller and the control thereof. With still more particularity, the present invention relates to start-up procedures for screw compressor-based water chiller systems, detection of a so-called inverted start conditions in such systems and control of such chillers to address the inverted start circumstance.

At and during the start-up of a refrigeration chiller, the majority of the chiller's refrigerant charge will normally be found in the shell of the system evaporator. This is because refrigerant, by its nature, tends to migrate to and settle in the coldest part of a chiller system when a chiller is not in operation and because the system evaporator will be the coldest location in the chiller for some period of time subsequent to its shutdown and, normally, when it next starts up. Also, pressure across a chiller system will typically have equalized during a shutdown period due to leakage paths that come to exist across the system only after it shuts down.

During "normal" start-up of a chiller, the system expansion valve, which meters refrigerant from the high pressure side ("high-side") to the low pressure side ("low-side") of the chiller system, is typically prepositioned to a nominal, more closed setting. Positioning of the expansion valve to the more closed setting occurs under the presumption, for the reasons noted above, that there is a sufficient amount of refrigerant in the system evaporator at chiller start-up to supply the system compressor until steady state operation is achieved.

Prepositioning of the expansion valve to such a relatively more closed position is done to allow a pressure differential to build up quickly between the high and low pressure sides of the chiller system, the boundaries of which are the system's expansion valve and compressor. The relatively quick buildup of such differential pressure at chiller start-up is necessary and critical in such systems because it is that pressure differential which is used to drive oil from its storage location in the chiller to the surfaces and bearings in the chiller that require a supply of oil in order to function. To further ensure a safe start for the chiller under such "normal" start-up conditions, a time delay may be built into the chiller's control logic only after which will the chiller be permitted to load.

In view of the above regarding refrigerant charge location under normal start-up circumstances, if the sensed evaporator leaving water temperature (the temperature at which the water leaves the evaporator after having passed through the tube bundle therein) is lower than the sensed condensing water temperature, current chiller systems presume that the majority of the system's refrigerant charge is in the system evaporator rather than the condenser. This is because, once again, refrigerant, by its nature, will tend to migrate to and settle in the coldest part of a chiller system when the system is not in operation. Colder evaporator water temperature is thought to confirm the presumption. Under such circumstances, "normal" chiller start-up logic will be used to bring the chiller on line with the expansion valve being positioned to a relatively closed down position.

The circumstance where a majority of a chiller system's refrigerant charge is in the system condenser rather than the system evaporator at start-up is referred to as an inverted start condition. In current chiller systems, the fact that sensed evaporator leaving water temperature is higher rather than lower than sensed condenser water temperature is presumed to indicate that the majority of the system's refrigerant charge is in the condenser rather than the evaporator and that an inverted start condition exists.

Inverted start conditions require that a unique control sequence be employed in starting the chiller due to the presumed unavailability of a sufficient quantity of refrigerant in the system evaporator to adequately feed the system compressor in the face of what would, under normal start-up conditions, be a relatively closed-down expansion valve. Absent an adequate supply of refrigerant in the system evaporator at start-up, buildup of an adequate pressure differential between the high and low-sides of the chiller system may not occur. That, in turn, jeopardizes the supply of lubricant to the compressor at start-up and the chiller may be subject to repeated failed starts or shutdowns, under a low oil pressure diagnostic, before conditions internal of the chiller "normalize" and a successful and sustained start can be achieved.

Currently, when the existence of an inverted start condition is suggested by virtue of the fact that condensing water temperature is sensed to be lower than evaporator water temperature, "inverted start-up logic" is used to start the chiller. That logic typically includes a pre-start step of opening the system expansion valve to a relatively more wide open position than would be found under "normal" start conditions. By so positioning the expansion valve, quick relocation of the refrigerant charge from the system condenser to the system evaporator is sought to be achieved. However, by virtue of the fact that the system expansion valve is so-positioned and constitutes a boundary between the high and low pressure sides of the chiller system, a relatively open flow path between the high and low-sides of the chiller system is caused to exist which is, in its own fashion, detrimental to the development of a pressure differential between the high and low pressure sides of the chiller. Further, in chiller systems where compressor loading is delayed during "normal" start-ups as an added measure of compressor/chiller protection, such delayed loading is often dispensed with under inverted start conditions due to the need to drive refrigerant out of the condenser and into the evaporator. The use of inverted start logic is therefore to be avoided if possible for the reason that a measure of safety is lost in terms of protecting the compressor as it starts up.

Still further, the fact that condenser water temperature is lower than evaporator water temperature at start-up, while normally a good indicator of the existence of inverted start conditions, is not a foolproof indicator. For instance, when a refrigeration chiller is used in conjunction with condensing water supplied from a cooling tower, the start-up of cooling tower pumps can cause water to flow to the chiller's condenser which is initially colder than evaporator leaving water temperature. Under that circumstance, the fact that the condensing water temperature is colder than evaporator leaving water temperature is not a reliable indicator of an insufficient refrigerant charge in the system evaporator to sustain chiller start-up (even though that may, in fact, be the case). Therefore, false indications of the existence of inverted start conditions can occur and inverted start-up logic is sometimes used when it is not called for. Use of inverted start-up logic when it is not, in fact, called for can cause extended refrigerant floodback to the compressor and no or low refrigerant superheat to be achieved, all to the detriment of chiller operation.

In a similar manner, there are certain circumstances where the use of inverted start logic is, in fact, called for but comparative evaporator and condenser water temperatures do not suggest the existence of the condition. As a result, "normal" start-up logic is sometimes used when inverted start logic is actually called for.

In both of these cases of erroneous indication, chiller shutdowns and failed starts often result, to the detriment of the industrial process or building comfort application in which the chiller is used. The need therefore exists to better determine the existence of inverted start conditions in refrigeration chillers and to better address those conditions when they do exist so that unnecessary failed starts and chiller system shutdowns are reduced or eliminated.

SUMMARY OF THE INVENTION

It is an object of the present invention to better identify the existence of inverted start conditions in a refrigeration chiller.

It is a further object of the present invention to identify the existence of inverted start conditions in a refrigeration chiller through means other than the comparison of condenser and evaporator leaving water temperatures.

It is an additional object of the present invention to avoid positioning the expansion valve in a chiller system at start-up based on misleading or erroneous indicators of the location of the refrigerant charge in the chiller.

It is a still further object of the present invention to more reliably identify the existence of inverted start conditions in a refrigeration chiller by sensing the liquid level in one, the other of or both of the system evaporator and system condenser.

These and other objects of the present invention, which will become apparent when the following Description of the Preferred Embodiment and attached Drawing Figure are considered, are achieved by sensing the level of liquid refrigerant in the evaporator of a refrigeration chiller prior to its start-up and by properly positioning the system expansion valve in accordance with the sensed liquid level to address the indicated start-up condition.

In the preferred embodiment, the level of liquid refrigerant in the system evaporator is sensed and communicated to the chiller system controller at start-up which, in turn, positions the system expansion valve to properly address the true location/condition of the system's refrigerant charge at start-up. If the sensed liquid level in the evaporator at start-up is lower than a predetermined level, the existence of an inverted start condition is confirmed and the system expansion valve is accordingly positioned to a more open position to accommodate the immediate movement of the refrigerant charge from the system condenser to the system evaporator.

In this manner, inverted start-up conditions are more reliably identified and addressed when they exist than in systems where potentially misleading system parameters, such as temperatures, are sensed and compared to identify the existence of such conditions. Further, by the continuous sensing of the liquid level in the evaporator, the expansion valve can be closed down in a controlled manner even as an inverted start condition is addressed. That better ensures that an adequate lubricant supply is made available to the compressor through the timely buildup of the high to low-side pressure differential across the chiller system. Unnecessary system shutdowns/failed starts associated with prior and current systems and their less accurate and reliable identification of the existence of inverted start conditions are avoided.

DESCRIPTION OF THE DRAWING FIGURES

The single Drawing FIGURE is a schematic view of the refrigeration chiller of the present invention in its de-energized state illustrating liquid refrigerant levels within the system condenser and evaporator which call for the use of normal chiller start-up logic and which, in phantom, illustrate refrigerant levels calling for the use of inverted start-up logic to bring the chiller on line.

DESCRIPTION OF THE PREFERRED EMBODIMENT

Figure 1:
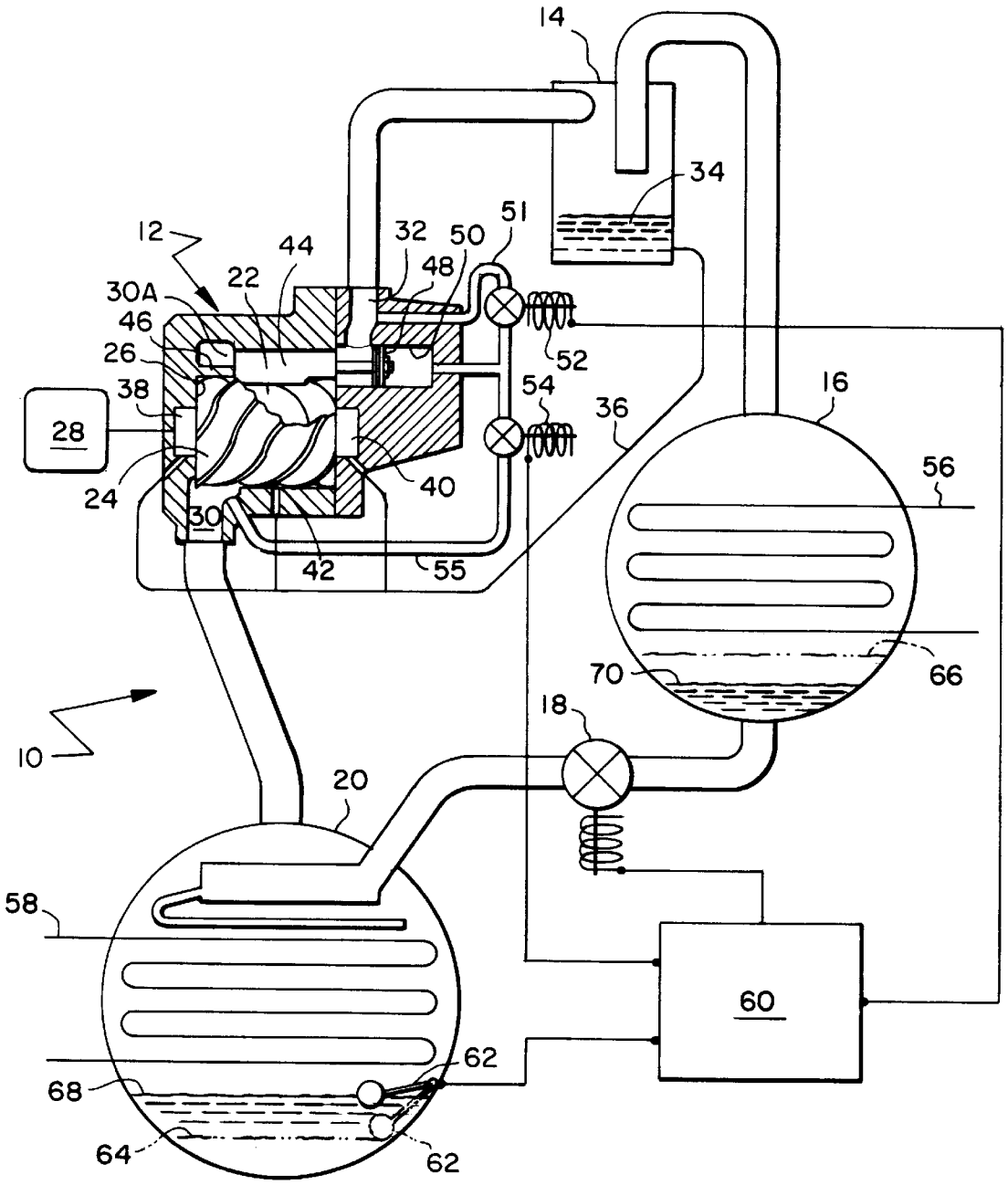

Chiller system 10 is comprised of a compressor 12, an oil separator 14, a condenser 16, an expansion valve 18 and an evaporator 20. All of these components are serially connected for refrigerant flow as will more thoroughly be described.

Compressor 12 is a compressor of the screw type in which screw rotors 22 and 24 are meshingly engaged in a working chamber 26. One of the rotors is driven by motor 28 when the chiller is in operation. Refrigerant gas is drawn into working chamber 26 from evaporator 20 through suction area 30 of the compressor and is compressed by the intermeshing rotation of the screw rotors therein. The gas is discharged from working chamber 26 into discharge area 32 of the compressor at significantly increased pressure and temperature.

By their nature, refrigeration screw compressors require the delivery of significant quantities of lubricant/oil to certain surfaces, bearings and internal locations for multiple purposes. After or during its use, such lubricant makes its way into the compressor's working chamber where it becomes entrained in the refrigerant gas undergoing compression therein and is discharged from the compressor. The discharge gas and its entrained lubricant are delivered to oil separator 14 where the majority of the oil is disentrained from the gas and collects in sump 34.

The relatively high discharge pressure that exists internal of oil separator 14 when compressor 12 is in operation is used to drive lubricant from sump 34 and through lubricant line 36 to, for instance, bearings 38 and 40 of the compressor and to oil injection port 42 which opens into the compressor's working chamber. The lubricant delivered to bearings 38 and 40 flows through the bearings, lubricating them in the process, and is then delivered into the stream of low pressure refrigerant gas undergoing compression within the compressor's working chamber. Such lubricant may be delivered into suction area 30 of the compressor or into a location in working chamber 26 where the pressure of the refrigerant gas has not yet been significantly elevated by the intermeshing rotation of the screw rotors. Other lubricant, as mentioned above, is injected directly into the working chamber of the compressor and into the gas undergoing compression therein through injection port 42. All of such lubricant is, once again, returned to oil separator 14 in a repetitive and continuous process.

Screw compressors are capable of having their capacities modulated by the use of so-called slide valves such as slide valve 44. Slide valve 44 is disposed so as to move axially with respect to screw rotors 22 and 24 and has contoured portions that conform to and form part of the inner wall of the compressor's working chamber. The slide valve is typically positioned under the rotors or over the rotors (as shown). When compressor 12 is fully loaded, slide valve 44 will abut slide stop 46 and will operate to compress refrigerant gas at its highest capacity.

When conditions, such as a lower heat load on system 10, permit the capacity of the compressor to be reduced, slide valve 44 is moved away from slide stop 46. Such movement exposes a portion of rotors 22 and 24 to suction area 30A of the compressor which is in flow communication with suction area 30. In effect, the further slide valve 44 is moved away from slide stop 46, the shorter will be the effective or "working" length of the screw rotors and the less capacity output the compressor will have. Energy savings and efficiency increases are achieved under such circumstances as a result of the reduced amount of work motor 28 is required to do.

Slide valve 44 can be moved within compressor 12 and with respect to rotors 22 and 24 in any one of a number of ways such as through the use of an electric motor, pressurized gas or, more typically, pressurized oil. In FIG. 1, slide valve 44 is connected to a slide valve actuating piston 48 which is disposed in slide valve actuating cylinder 50. When chiller system 10 is in operation, gas at discharge pressure is communicated from discharge area 32 of compressor 12, through passage 51 and into slide valve actuating cylinder 50 by opening load solenoid 52. That causes movement of slide valve 44 in a direction which loads the compressor.

By venting slide valve actuating cylinder 50 to a location within the chiller system which is at less than discharge pressure, such as by the opening unload solenoid 54 and venting cylinder 50 to suction area 30 through passage 55, piston 48 and slide valve 44 are caused to move away from slide stop 46. Such movement results in the unloading of the compressor and, once again, results in energy savings by reducing the amount of work motor 28 must perform. It is to be noted that a measure of compressor and chiller protection is gained, when normal chiller start-up conditions exist, by delaying the loading of compressor 12 for a short period of time, such as three minutes, subsequent to start-up. This ensures that relatively stable operation will have been achieved and that adequate oil is being supplied to compressor before a load is placed on the compressor to meet the demand for the chilled liquid produced by the chiller.

With respect to operation of the chiller and that of its condenser and evaporator components, water is delivered through piping 56 into the interior of condenser 16 in the chiller system of FIG. 1. The water flowing through condenser 16 can come from any number of sources such as city water, a collection pool, a ground source, a cooling tower, etc. When the chiller is in normal operation, relatively high temperature, high pressure refrigerant gas is delivered into the interior of condenser 16 from oil separator 14 and is there cooled by heat exchange with the condenser water flowing through piping 56. The heat exchange process that occurs in the condenser results in the liquification of the refrigerant and the pooling of the cooled but still high pressure refrigerant at the bottom of the condenser shell.

The relatively cool liquid refrigerant is metered out of the condenser through expansion valve 18, which will preferably be of the electronic, fully modulating type, in a controlled quantity. The refrigerant is then delivered to system evaporator 20, which, in the preferred embodiment, is an evaporator of the falling-film type. Such refrigerant, having been still further cooled and significantly reduced in pressure as a result of its passage through expansion valve 18, then undergoes heat exchange contact with water or another liquid heat exchange medium which flows through tubing 58 of evaporator 20.

The chilled water produced as a result of the heat exchange process that occurs in evaporator 20 is delivered, via piping 58, to the location of a heat load that requires cooling such as a space within a building or the place at which an industrial process using chilled water occurs. The temperature of the evaporator water is elevated at the location of the heat load by its exchange of heat therewith and the heat load is, in turn, cooled which is the ultimate purpose of the chiller. The now relatively much warmer evaporator water is returned from the location of the heat load to evaporator 20 where it once again undergoes heat exchange with system refrigerant in a process that continues so long as the chiller is in operation.

When chiller system 10 shuts down, the forced flow of refrigerant through it ceases and the pressure across the chiller system equalizes over time. Likewise over time, system refrigerant will normally migrate to the at least initially "colder" system evaporator where it settles in liquid form.

Sufficient refrigerant can, therefore, normally be expected to be available in the evaporator when the chiller next starts-up to supply the compressor and chiller system until steady state chiller operation is achieved. As a result, expansion valve 18 can normally be positioned to a relatively closed-down position at start-up which facilitates the rapid development of differential pressure between the high and low pressure-sides of the chiller system. That, in turn, ensures that an adequate supply of oil is timely made available to the system compressor which permits its continued operation once started.

Under circumstances where sufficient refrigerant is for some reason not located in evaporator 20 when chiller 10 starts-up after a shutdown period, a so-called "inverted start" condition exists. Under that circumstance, expansion valve 18 is positioned to a relatively more fully-open position to ensure the rapid delivery of a sufficient quantity of refrigerant from upstream of expansion valve 18 into the system evaporator. Also, the protective delay in loading the chiller at start-up during "normal" start-ups is dispensed with to facilitate the driving of refrigerant out of the condenser to the evaporator. The fact that expansion valve 18 must be positioned to a relatively more open position under inverted start circumstances exacerbates and makes more difficult the achievement of a successful chiller start for the reason that the development of a sufficient high to low-side pressure differential to ensure that the compressor is adequately lubricated is thereby caused to take an extended period of time. If that extended period is too long, the chiller may shut down on a low oil pressure diagnostic. Further, the degree to which the compressor is protected against damage at start-up is diminished as a result of the need to load the compressor immediately in an effort to drive refrigerant from the condenser to the evaporator.

Still further, the existence of inverted start conditions in current systems is much more likely to be erroneously identified due to the system parameters that are sensed and used to identify them. In that regard, current systems often compare condensing water temperature to evaporator water temperature to determine if inverted start conditions exist in a chiller. Erroneous identification of the existence of an inverted start condition can result in the control of the chiller at start-up using inverted start logic when such control is inappropriate. That can result in still further and unnecessary interruptions of chiller service. Similarly, the use of condenser and evaporator water temperatures can sometimes suggest that inverted start conditions do not exist when, in fact, they do causing still further and unnecessary interruptions of chiller service as a result of the failure to use inverted start logic when it is called for.

In the chiller system of the present invention, controller 60 controls, among other things, the position of expansion valve 18, slide valve load solenoid 52 and slide valve unload solenoid 54. Additionally, controller 60, is in communication with evaporator 20 and liquid level sensor 62 therein. Such communication permits controller 60 to take into account, in a dynamic and highly accurate manner, the level of liquid refrigerant in evaporator 20 both in controlling the chiller system in operation and in addressing inverted start conditions.

In the preferred embodiment, control of chiller system 10 is predicated, in part, on the fact that evaporator 20 is a so-called falling film evaporator of the type described in applicant's co-pending and commonly assigned U.S. patent application filed Feb. 14, 1997, Ser. No. 08/801,545 which is incorporated herein by reference. In many such systems, the liquid level within the evaporator is sensed and used to efficiently control system operation, not only at start-up, but during steady-state operation.

In the preferred embodiment, liquid level in the evaporator is controlled so as to be maintained at a predetermined level while the chiller is in operation. Maintenance of that liquid level optimizes the heat transfer process in the evaporator. Therefore, while sensor 62 exists in chiller system 10 for purposes other than sensing and addressing the existence of inverted start conditions, it does make the liquid level in evaporator 20 a parameter that is available to controller 60 even when the chiller is not operating. By having knowledge of the actual liquid level in evaporator 20 prior to chiller start-up, controller 60 is able to identify, without resort to presumption and without reliance on the measurement of system-related temperatures that can provide false indications, whether or not an inverted start condition exists within the chiller.

While in the preferred embodiment, sensor 62 has uses other than with respect to identifying and addressing inverted start conditions, it is to be understood that the present invention also contemplates the use of a liquid level sensor dedicated to identifying inverted start conditions and the use of such a dedicated sensor in chiller systems having evaporators which are of other than the falling-film type. It is also to be understood that the liquid level in the system condenser can similarly be sensed and used as an indicator of the location of the system's refrigerant charge at chiller start-up.

When an adequate liquid level 68 in the Drawing Figure) is sensed in evaporator 20 corresponding to a "normal" shutdown liquid level 70 in condenser 16, controller 60 in the present invention pre-positions expansion valve 18 to a relatively closed-down setting having ensured, by sensing the liquid level in the evaporator, both that there is adequate refrigerant available in the evaporator to initially supply the system compressor in the face of the relatively closed down expansion valve and that a pressure differential across the system will rapidly develop as a result thereof. On the other hand, if controller 60, through sensor 62, identifies that a low liquid level 64 (shown in phantom) exists in evaporator 20 at start-up, corresponding to a high liquid level 66 (likewise shown in phantom) in condenser 16 (or to a possible loss of refrigerant charge which is likewise capable of being suggested by sensor 62), the existence of an inverted start condition is verified. Expansion valve 18 is then prepositioned by controller 60 to a more open position so as to allow refrigerant to pass rapidly from condenser 16 to evaporator 20 as the chiller start up.

Controller 60 then monitors the level of liquid in evaporator 20 as it rises to acceptable levels and closes down expansion valve 18 accordingly to facilitate the development of a high to low-side pressure differential as quickly as possible under the circumstance. Chiller shutdowns resulting from false, inaccurate or misleading system indicators, such as temperatures that are influenced by other than the existence of inverted start conditions, are avoided. Further, controller 60's "read" on the liquid level in the evaporator is instantaneous, dynamic and accurate permitting it to expeditiously close down expansion valve 18 by "following" the progress of refrigerant relocation as it occurs during a chiller start whereas parameters such as system temperature often lead or lag the condition which causes them making a timely response to the condition difficult. Once chiller start-up is achieved and steady-state operation is reached, the setting of expansion valve 18, in the preferred embodiment, is controlled by controller 60 to maintain a liquid level in evaporator 20 which is predetermined to optimize the heat transfer process in the evaporator.

In sum, when inverted start conditions do exist in chiller system 10 of the present invention, the condition is more accurately and reliably identified and system operation is better controlled in bringing the chiller on-line, keeping it on-line and maintaining it in operation until steady state operating conditions are achieved. The overall result is that failed starts relating to inverted start conditions, whether such conditions exist and are not properly identified or do not exist and are erroneously identified as existing, are reduced or avoided altogether.

Although the present invention has been described in terms of a preferred embodiment, it is to be understood that the invention is not limited thereto and encompasses modifications, alternatives and equivalents not specifically addressed herein.

What is claimed is:

1. A refrigeration chiller comprising:

a compressor, said compressor being a screw compressor having a capacity control valve;

a condenser;

an expansion valve;

an evaporator, said compressor, said condenser, said expansion valve and said evaporator all connected for serial flow;

a liquid level sensor disposed in at least one of said evaporator and said condenser; and a controller, said controller positioning said expansion valve and said capacity control valve of said compressor, at chiller start-up, in accordance with the liquid level sensed by said liquid level sensor.

2. The refrigeration chiller according to claim 1 wherein said liquid level sensor is located in said evaporator.

3. The refrigeration chiller according to claim 2 wherein said controller sets said expansion valve to a relatively more open position at chiller start-up and causes said capacity control valve to be positioned to load said chiller more quickly when the level of liquid sensed in said evaporator at chiller startup is below a predetermined level.

4. The refrigeration chiller according to claim 3 wherein said controller uses the liquid level sensed by said liquid level sensor to control the position of said capacity control valve and the operation of said chiller other than at chiller start-up.

5. The refrigeration chiller according to claim 1 wherein the positioning of said capacity control valve by said controller so as to load said chiller at chiller start-up is controlled by said controller to occur more quickly when the liquid level sensed by said liquid level sensor is below a predetermined level than when the level of liquid sensed by said liquid level sensor is above said predetermined level.

6. The refrigeration chiller according to claim 5 wherein said evaporator is a falling film evaporator.

7. A refrigeration chiller comprising:

a compressor;

a condenser;

an expansion valve;

an evaporator, said compressor, said condenser, said expansion valve and said evaporator all connected for serial flow;

a liquid level sensor, said sensor sensing the level of liquid in at least one of said evaporator and said condenser; and a controller, said controller positioning said expansion valve at chiller start-up in accordance with the liquid level sensed by said liquid level sensor, said controller (i) setting said expansion valve to a relatively more open position at chiller start-up when the level of liquid sensed by said liquid level sensor is below a predetermined level, (ii) setting said expansion valve to a relatively more closed position at chiller start-up when the level of liquid sensed by said liquid level sensor is above said predetermined level and (iii) delaying the loading of said compressor at chiller start-up when the level of liquid sensed by said liquid level sensor is above said predetermined level.

8. The refrigeration chiller according to claim 7 wherein said compressor is a screw compressor having a capacity control valve, said controller causing said capacity control valve to move in a direction which loads said compressor at chiller start-up more quickly when the level of liquid sensed by said liquid level sensor is below said predetermined level than the delayed loading of said compressor that occurs when said level is above said predetermined level.

9. A refrigeration chiller according to claim 7 wherein said liquid level sensor is located in said evaporator and wherein said controller positions said expansion valve to a relatively more closed position subsequent to having been set to a relatively more open position at chiller start-up at such time as the level of liquid sensed in said evaporator reaches said predetermined level.

10. A liquid chiller comprising:

a screw compressor;

an oil separator, said oil separator receiving compressed refrigerant gas discharged from said compressor and disentraining oil therefrom;

means for modulating the capacity of said compressor;

a condenser, said condenser receiving refrigerant gas from said oil separator and condensing said refrigerant to liquid form;

an evaporator;

means for metering liquid refrigerant from said condenser into said evaporator;

means for sensing a level of liquid in said evaporator; and a controller, said controller being in communication with (i) said means for sensing liquid level (ii) said means for modulating the capacity of said compressor and (iii) said means for metering refrigerant from said condenser to said evaporator, said controller positioning said means for metering and said means for modulating the capacity of said compressor, when said chiller starts up, in accordance with the liquid level sensed in said evaporator.

11. The liquid chiller according to claim 10 wherein said means for metering comprises an electronic expansion valve and wherein said controller positions said expansion valve to a relatively more open position and positions said means for modulating capacity so as to load said compressor more quickly, at chiller start-up, when the liquid level in said evaporator is sensed to be lower than a predetermined level.

12. The liquid chiller according to claim 11 wherein said means for controlling closes said expansion valve from said relatively more open position at such time as the liquid level in said evaporator reaches said predetermined level.

13. The liquid chiller according to claim 11 wherein said means for modulating the capacity of said compressor is actuated using refrigerant gas discharged from said compressor.

14. The liquid chiller according to claim 11 wherein said evaporator is a falling film evaporator.

15. The liquid chiller according to claim 11 wherein said controller controls the operation of said liquid chiller using the liquid level sensed by said means for sensing both at chiller start-up and thereafter.

16. The liquid chiller according to claim 10 wherein said controller delays the positioning of said means for modulating the capacity of said compressor when the liquid level in said evaporator is sensed by said means for sensing to be higher than a predetermined level.

17. A method of controlling the start-up of a refrigeration chiller comprising the steps of:

establishing a predetermined level of liquid refrigerant in the evaporator of the chiller which is indicative of the existence of sufficient liquid refrigerant in said evaporator to permit the use of a first start-up control sequence for said chiller;

sensing the level of liquid refrigerant in at least one of the evaporator and the condenser of said chiller prior to starting said chiller;

positioning the expansion valve of said chiller to a first position at chiller start-up if the sensed liquid level is lower than said predetermined level; and positioning the expansion valve of said chiller to a second position and using said first start-up control sequence to start said chiller if the sensed liquid level is higher than said predetermined level.

18. The method according to claim 17 wherein said sensing step comprises the step of sensing the liquid level in said evaporator.

19. A method according to claim 17 wherein said first start-up control sequence includes the step of delaying the loading of the compressor of said chiller for a predetermined amount of time after chiller start-up.

20. The method according to claim 19 comprising the further step of maintaining the level of liquid in said evaporator at a level proximate said predetermined level subsequent to chiller start-up.

21. The method according to claim 19 wherein said step of positioning the expansion valve of said chiller to a first position at chiller start-up if the sensed liquid level in said evaporator is lower than a predetermined level includes the step of positioning the expansion valve to permit relatively increased refrigerant flow from the chiller condenser to the chiller evaporator at chiller start-up as compared to the refrigerant flow permitted through the expansion valve when the sensed liquid level in said evaporator at start-up is higher than said predetermined level.

22. The method according to claim 19 comprising the further step of changing the position of said expansion valve so as to decrease refrigerant flow from the chiller condenser to the chiller evaporator at such time as the liquid level sensed in said evaporator increases to said predetermined level subsequent to having been below said predetermined level at start-up.

* * * * *